US012774642B2

(12) United States Patent
Lovstrom

(10) Patent No.: US 12,774,642 B2
(45) Date of Patent: Oct. 27, 2026

(54) COIL TUBING INJECTOR APPARATUS AND METHOD WITH ADVANCED LUBRICANT DISTRIBUTION

(71) Applicant: Coil Solutions Inc., Medicine Hat (CA)

(72) Inventor: Bruce Lovstrom, Calgary (CA)

(73) Assignee: COIL SOLUTIONS, INC., Medicine Hat (CA)

( * ) Notice: Subject to any disclaimer, the term of this patent is extended or adjusted under 35 U.S.C. 154(b) by 0 days.

(21) Appl. No.: 18/966,781

(22) Filed: Dec. 3, 2024

(65) Prior Publication Data

US 2025/0179887 A1 Jun. 5, 2025

Related U.S. Application Data

(60) Provisional application No. 63/605,634, filed on Dec. 4, 2023.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS

| | | | | |
|---|---|---|---|---|
| 5,918,671 | A | 7/1999 | Bridges et al. | |
| 6,173,769 | B1 | 1/2001 | Goode | |
| 6,347,664 | B1 | 2/2002 | Perio, Jr. | |
| 6,910,530 | B2 | 6/2005 | Austbo et al. | |
| 8,191,620 | B2 | 6/2012 | Maschek, Jr. et al. | |
| 9,243,463 | B2 | 1/2016 | Hassard | |
| 2014/0041853 | A1* | 2/2014 | Dineen | E21B 19/22 166/77.3 |
| 2016/0102506 | A1* | 4/2016 | Hassard | E21B 19/22 166/382 |

* cited by examiner

*Primary Examiner* — Yanick A Akaragwe
(74) *Attorney, Agent, or Firm* — William P. Ramey, III; Jacob B. Henry; Ramey Firm

(57) ABSTRACT

A coiled tubing injector apparatus for inserting and removing coiled tubing from a wellhead with a lubricant distribution system that significantly reduces wear and prolongs the life of the injector.

15 Claims, 8 Drawing Sheets

COIL TUBING INJECTOR APPARATUS AND METHOD WITH ADVANCED LUBRICANT DISTRIBUTION

CROSS-REFERENCE TO RELATED APPLICATION

This application claims priority benefit of U.S. Provisional Application No. 63/605,634, entitled Coil Tubing Injector Apparatus and Method, filed on Dec. 4, 2023, and which is entirely incorporated by reference herein.

BACKGROUND OF THE INVENTION

Field of the Invention

The present invention relates generally to oilfield production equipment and, more particularly, to a coiled tubing injector apparatus for inserting and removing coiled tubing from a well in which grooved skate rollers provide improved lubrication dispersion on a skate and/or a wear plate.

Description of the Related Art

Coiled tubing has seen a marked increase in use through the oil and gas industry since its inception. Coiled tubing operations have grown from the limited applications thought feasible in the early 1950's and are now considered a viable solution in multiple operations, including subsea wells, snubbing, fracturing, and even coiled tubing applications. Coiled tubing operations have grown more popular as a result of their rapid mobilization times and generally smaller footprint with respect to traditional well operations. Furthermore, they require less site crew and personnel, in addition to significant cost savings. As applications for coiled tubing have become more numerous, the strength and size of the coiled tubing has increased in options as well. Coiled tubing was generally less than 1 in. in diameter in the beginning, while it can be found now in sizes up to 4 in. in diameter.

Coiled tubing rigs primarily consist of an injector head for inserting and removing the coiled tubing from the wellhead, a spool reel for storing and transporting the coiled tubing, a power pack to power the injector head, and a control room to operate the machinery. The injector head is responsible for gripping the coiled tubing, usually through a series of grippers powered by a chain design, which provide enough force to move the tubing when necessary, without impeding the structural stability of the tubing. Although the other components are required to functionally operate the system, the injector head is the integral part of a coiled tubing rig.

The injector head comprises components that are subject to considerable wear and therefore require frequent maintenance.

The following patents discuss background art related to the above discussed subject matter:

U.S. Pat. No. 8,191,620, issued Jun. 5, 2012, to Maschek, Jr. et al. discloses a gripper assembly for use within a coiled tubing injector unit. The gripper assembly comprises a carrier for securing the gripper to the chain drive mechanism of the coiled tubing injector unit and a gripping shoe carried by the carrier. The configuration of the gripper assembly permits removal and replacement of the gripping shoe.

U.S. Pat. No. 6,910,530, issued Jun. 28, 2005, to Austbo et al. discloses a coiled tubing injector apparatus for use in inserting coiled tubing into a well, temporarily suspending the coiled tubing, and removing the coiled tubing from the well is described. The apparatus includes a base with a pair of spaced-apart carriages extending upwardly therefrom. The base is part of a frame positioned above a wellhead. The carriages each have a gripper chain drive system rotatably mounted thereon and movable therewith. An actuation and linkage system allows the carriages to move toward and away from one another in a lateral or transverse direction with respect to the superstructure and the base. Thus, the gripper chain systems comprise gripper chains that can be engaged or disengaged from the coiled tubing extending through the apparatus. A wetting fluid basin is positioned below the gripper chains, and support guides engage the coiled tubing below the gripper chains to prevent buckling of the coiled tubing. The gripper chain drive system includes idler sprockets mounted on an idler sprocket shaft. The position of first and second ends of the idler sprocket shaft are monitored and may be adjusted to maintain a parallel relationship with a drive sprocket shaft on which are mounted drive sprockets supporting the gripper chain.

U.S. Pat. No. 6,347,664, issued Feb. 19, 2002, to Perio, Jr. discloses a coiled tubing injector head comprised of a plurality of endless chains, each of which are at least three links wide, that are positioned around a plurality of sprockets and/or idler rollers within the injector head. A plurality of gripper assemblies are positioned around the middle links of the endless chains. A bearing skate is positioned within the injector head, the bearing skate being comprised of a plurality of bearings in a staggered configuration, the bearings being adapted for rolling engagement with a portion of the gripper assemblies. An injector head is comprised of a plurality of halves, each of the halves being coupled to a positioning bar, the positioning bar having a plurality of openings formed therein, the openings adapted for use in varying the distance between the first and second halves.

U.S. Pat. No. 6,173,769, issued Jan. 16, 2001, to Goode discloses a gripping element of a coiled tubing injector has a carrier and a removable gripping shoe mounted to the carrier. The removable shoe slides onto slots formed on the carrier and is floated on the carrier by inserting an elastomeric pad sandwiched between the carrier and shoe. A manually depressible spring along one side of the carrier prevents the shoe from sliding out of the slots during operation of the injector.

U.S. Pat. No. 5,918,671, issued Jul. 6, 1999, to Bridges, et al. discloses an injector for flexible tubing has endless drive conveyors on opposite sides of a pathway for the tubing. The drive conveyors include gripper blocks that work in opposing pairs along the tubing pathway. The pairs of gripper blocks are clamped to the tubing and moved along the tubing pathway to either inject the tubing into a well or withdraw the tubing from a well. The gripper blocks are clamped to the tubing by way of skates, which work in opposing pairs. The skates have rollers, with rollers contacting the gripper blocks. Each roller has two ends, which ends are received by bearings inside of mounts on the respective skate.

U.S. Pat. No. 9,243,463, issued Jan. 26, 2016, to Hassard discloses a coiled tubing injector apparatus for inserting and/or removing coiled tubing from a well head comprising a first injector column and a second injector column forming a central pathway within a frame. The first and second injector columns each comprise an inner and outer band, the outer band containing a plurality of rolling elements for engaging the coiled tubing and the inner band creating drive force to energize the outer band. The inner band further comprises a wear plate designed to sustain the majority of wear for less costly maintenance and repair of injection heads.

The solutions provided by prior art have not been wholly satisfactory as coiled tubing has needed to reach further depths and operate under harsher conditions than was previously the case. Thus, there is room for improvement in the art.

SUMMARY OF THE INVENTION

An embodiment of this disclosure includes is coiled tubing injector apparatus for inserting and removing coiled tubing from a wellhead, comprising: a first and second band of opposed gripping members arranged for gripping said coiled tubing in a central pathway; a first and second inner chain operable to drive said first and second bands; a first and second skate plate, each of said first and second skate plate defining a channel and a plurality of recesses along both sides of said channel; a wear plate sized to fit within said channel of each said skate plate, said wear plate further comprising a plurality of openings, wherein said plurality of recesses and said plurality of openings align when said wear plate is inserted into said channel of each said skate plate; a chain comprising a plurality of rollers kept in place by a protuberance running along a length of the wear plate, each roller having at least one groove adapted to urge lubricant down at least a portion of the length of the wear plate; and a plurality of clamps for fastening each said wear plate to each said skate plate, wherein a first end of said plurality of clamps fits within said plurality of recesses and a second end of said plurality of clamps defines a tongue for insertion in said plurality of openings.

Another embodiment of this disclosure is a coiled tubing injector apparatus, comprising: a first injector column comprising a skate plate and a wear plate, said skate plate comprising a central track sized to receive said wear plate and a plurality of indentions along both sides of said central track, said wear plate further comprising a plurality of slots, wherein said plurality of slots and said plurality of indentions align when said wear plate is inserted into said central track of said skate plate, and a chain comprising a plurality of rollers kept in place by a protuberance running along a length of the wear plate, each roller having at least one groove adapted to urge lubricant down at least a portion of the length of the wear plate; a second injector column comprising a skate plate and a wear plate, said skate plate comprising a central track sized to receive said wear plate and a plurality of indentions along both sides of said central track; and a plurality of clamps for fastening said wear plate to said skate plate of both said first injector column and said second injector column, each of said plurality of clamps forming an extension of said wear plate aligning with said plurality of indentions and operable for securing said wear plate in position relative to said skate plate, and a chain comprising a plurality of rollers kept in place by a protuberance running along a length of the wear plate, each roller having at least one groove adapted to urge lubricant down at least a portion of the length of the wear plate.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Aspects of the disclosure are directed to grooved skate rollers for improved lubrication dispersion on a skate plate. The grooved rollers and skate plate enable a coil feeding apparatus to operate cooler with reduced friction than previously existed. Aspects of this disclosure include a grooved lubrication channel for greater lube dispersion throughout the skate plate.

At least one technical advantage of the disclosed systems is that it will reduce wear and stress on applicable components for increased service life of skate system.

Figure 1:
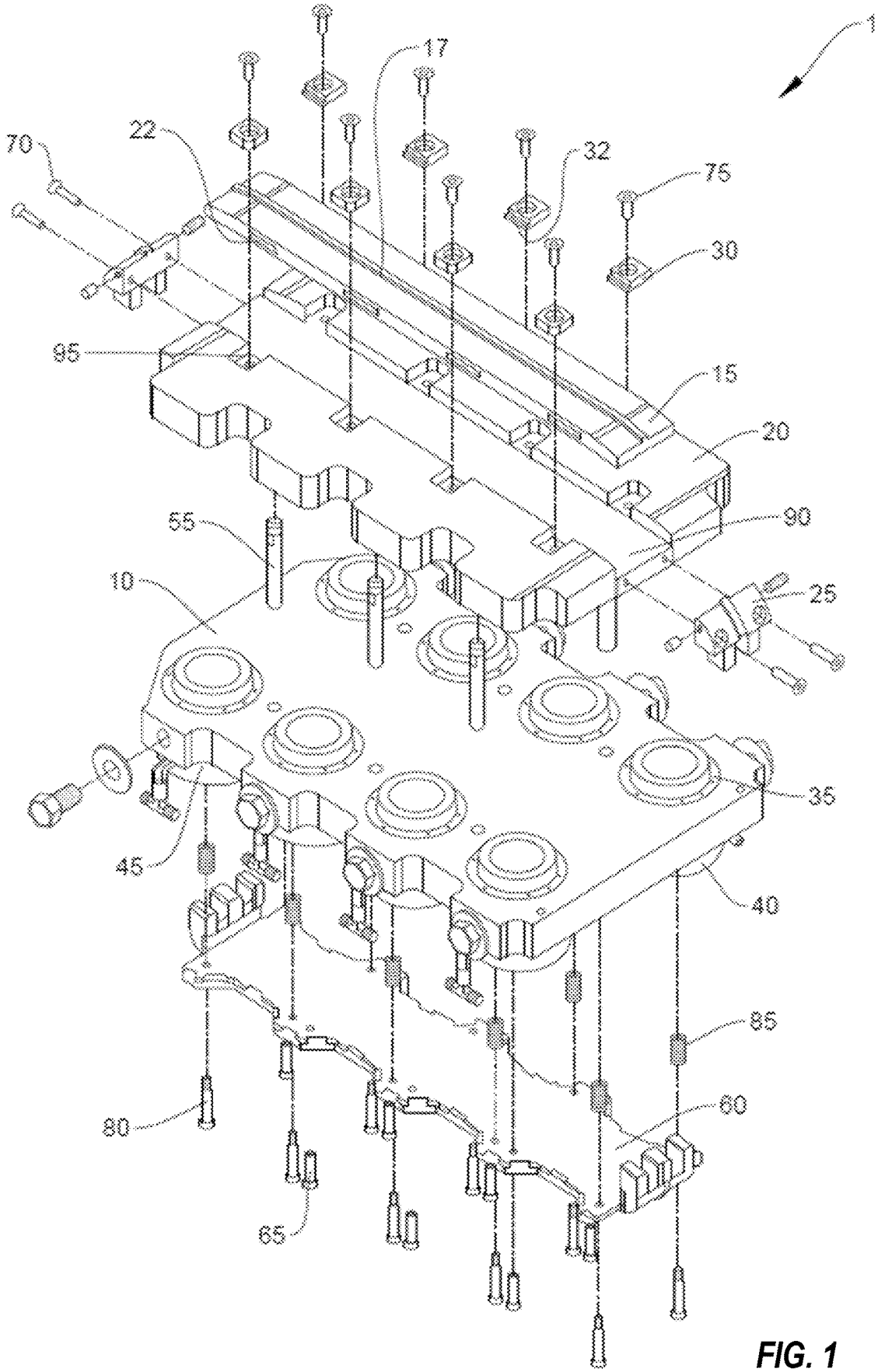
FIG. 1 is an exploded perspective view of a portion of a coiled tubing injector apparatus showing a skate plate in accord with one possible embodiment of the present invention.
Figure 8:
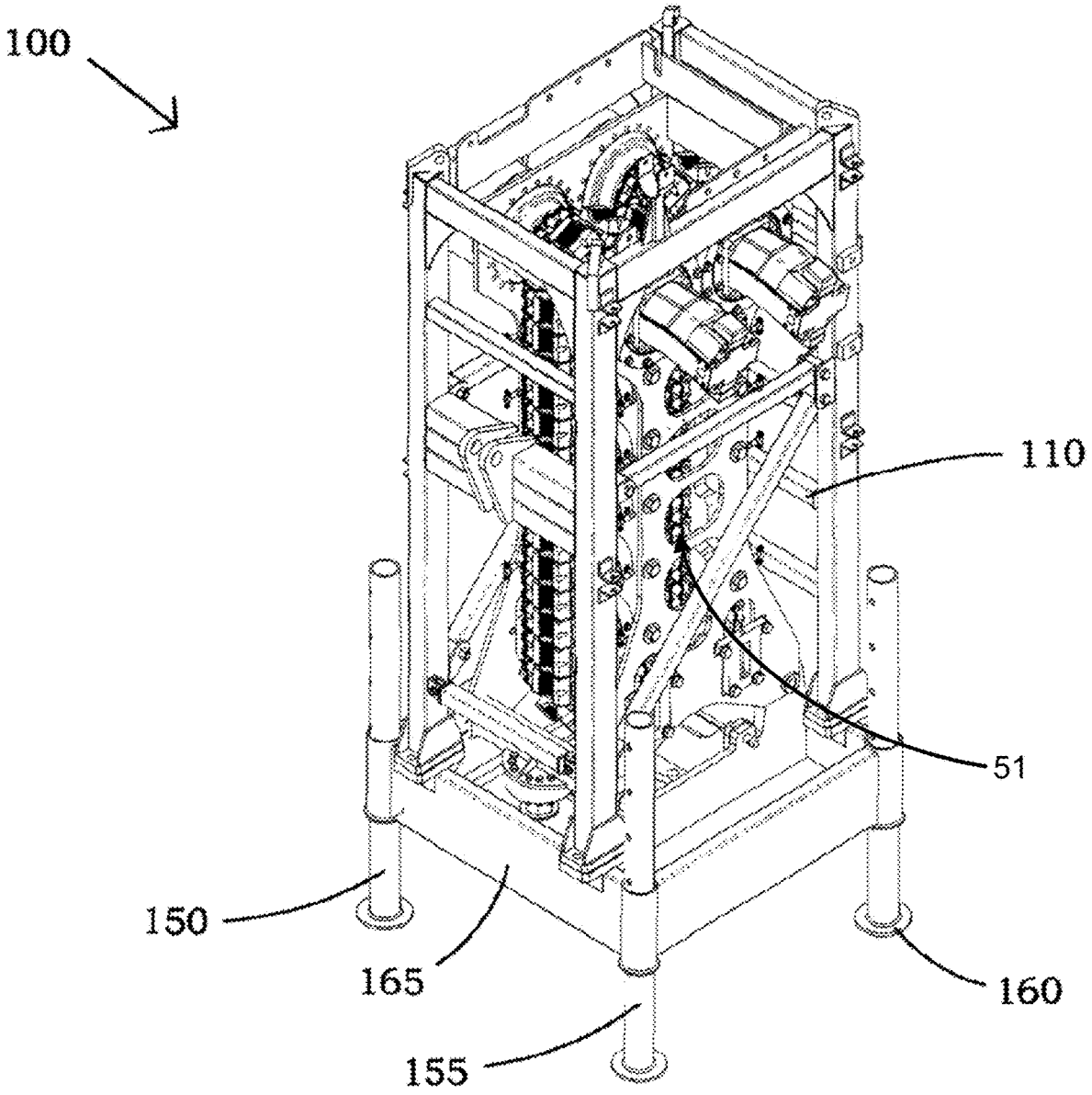
FIG. 8 is a perspective view of a coiled tubing injector apparatus in accord with one possible embodiment of the present invention.

Referring now to the drawings, and more particularly to FIG. 1, there is shown an exploded view of internal assembly 1, which is a portion of coiled tubing injector apparatus 100, shown assembled in FIG. 8, in accord with one possible embodiment of the present invention. In one embodiment, existing coiled tubing injector units may be modified or retrofitted in accord with the present invention for longer and more reliable operation. In one embodiment, coiled tubing injector 100 utilizes a chain-on-chain skate design in which manufactured grooved rollers may be connected to chain links and is designed for various pulling and snubbing applications. Coiled tubing injector 100 can be used for conveying various sizes of coiled tubing into and out of wells for a variety of other oil and gas operations.

Internal assembly 1 utilizes center plate 10, which comprises a plurality of circular orifices in which cylinder retaining rings 35 retain hydraulic cylinders 40, in the process of compressing grippers that are used to grip the pipe. Skate plate 20 is located on a first side of center plate 10 and may be mounted to center plate 10 by support posts 55. Skate plate 20 may, in one embodiment, be rectangular shaped with elongated sides containing cutout portions that correspond with cylinder retaining rings 35 of center plate 10 so as not to interfere with the operation of hydraulic cylinders 40. Skate plate 20 further comprises channel 90 sized to receive elongate wear plate 15. In this embodiment, it is not necessary that the entire skate plate be comprised of hardened material designed for longer wear in response to friction. Moreover, wear to skate plate is limited for less expensive repairs. Wear plate 15 is clamped to skate plate 20 by a plurality of clamp plates 30, which fit within recesses 95 formed along channel 90 of skate plate 20. Wear plate 15 may be thicker than channel 90 and, if desired, extend outwardly from skate plate 20. Recesses 95 and clamp plates 30 may be shaped differently than shown and could be elongate. Clamp plates 30 further each comprise at least one tongue 32 which fit within corresponding slots 22 of wear plate 15. Tongue 32 may be rectangular, round, or the like. In another embodiment, clamp plates 30 may be machined onto wear plate 15 with tongue 32 for insertion into corresponding recess 95 on skate plate 20.

Cap screws 75 further secure clamp plates 30 to skate plate 20, but do not bear any of the lateral forces created through operation of coiled tubing injector 100. The lateral forces on clamp plates 30 are supported by the walls of recesses 95 and the walls of slots 22, therefore cap screws 75 need only fasten clamp plates 30 to skate plate 20, a force which is not resisted during operation.

Tensioner assembly 60 is located on an opposite side of center plate 10 with respect to skate plate 20 and secured to center plate 10 by bolts 80 and socket head screw 65. Other types of fasteners may be utilized for this operation. Tensioner assembly 60 supports a plurality of injector springs 85 corresponding with hydraulic cylinders 40 respectively. Injector springs 85 expand and compress in response to the force exerted by hydraulic cylinders 40 during operation. Cylinder spacers 45 are placed between hydraulic cylinders 40 and center plate 10 for alignment purposes and to provide extended operation to account for size differences in coiled tubing. Tensioner assembly 60 comprises at least two prong sets which are for connecting with at least two of side plates 25 for securing tensioner assembly 60 with skate plate 20. Side plates 25 interlock with tensioner assembly 60 and then are secured to skate plate 20 by small cap screws 70. In other embodiments, alternative means of attaching side plates 25 with skate plate 20 may be used including pins, clamps, and the like. Side plates 25 mate with wear plate 15 and guide chain assembly 50 around skate plate 20 and wear plate 15. In one embodiment, wear plate 15 comprises track 17 upon which chain assembly 50 revolves along during operation of coiled tubing injector apparatus 100, to be discussed in more detail hereinafter.

Figure 2:
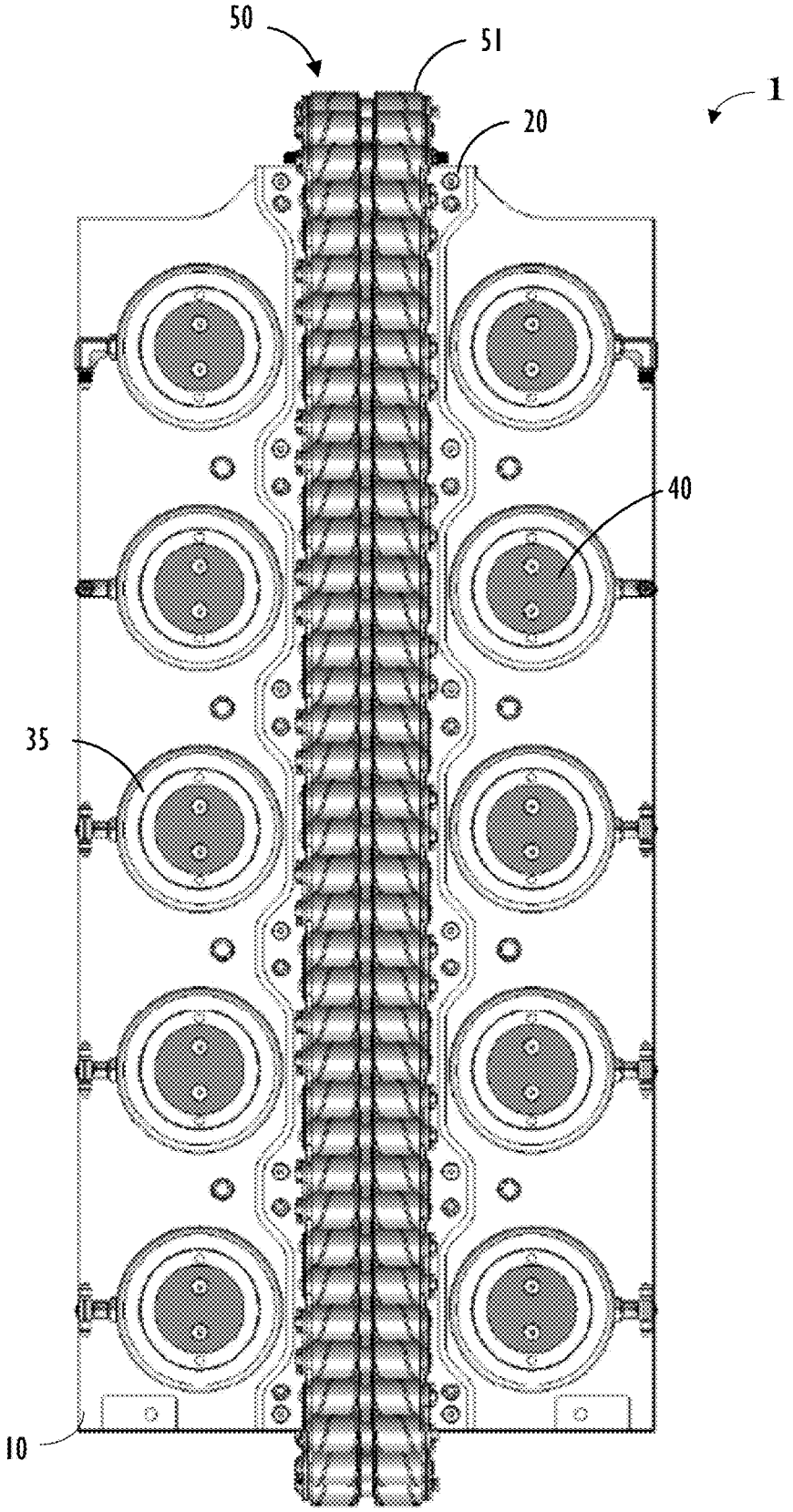
FIG. 2 is a top elevational view of a part of a coiled tubing injector apparatus showing a chain drive and skate plate in accord with one possible embodiment of the present invention.

Turning now to FIG. 2, a top view of internal assembly 1, with respect to the view of FIG. 1, is depicted in accord with one possible embodiment of the present invention. Chain assembly 50 comprises a plurality of grooved rollers interconnected by a series of chain links rotating along track 17 of wear plate 15 (See FIG. 1). However, the present invention is not limited to the current depiction of chain assembly 50 and may include alternative configurations in accord with the present invention. In another embodiment, chain assembly 50 may further comprise a skate cylinder traction beam and an alternative drive chain tension system, i.e. chain sprockets, planetary gears, hydraulic motors and/or controls, and the like may be used to drive chain assembly 50. Chain assembly comprises a plurality of grooved rollers 51. Each roller 51 has two lobes separated by an axle portion, with each lobe having a groove tracing the circumference along a length thereof. In the embodiment of FIG. 2, the grooves of each lobe mirror one another across the midway point of each roller 51. The grooves in the rollers 51 facilitate transmission of lubricant (e.g., oil) by the rollers 51 as the rollers move along wear plate 15 during normal operations. Skate plate 20 is fashioned to fasten with center plate 10 so that it does not interfere with hydraulic cylinders 40 or cylinder retaining rings 35 during normal operation of coiled tubing injector apparatus 100.

Figure 3:
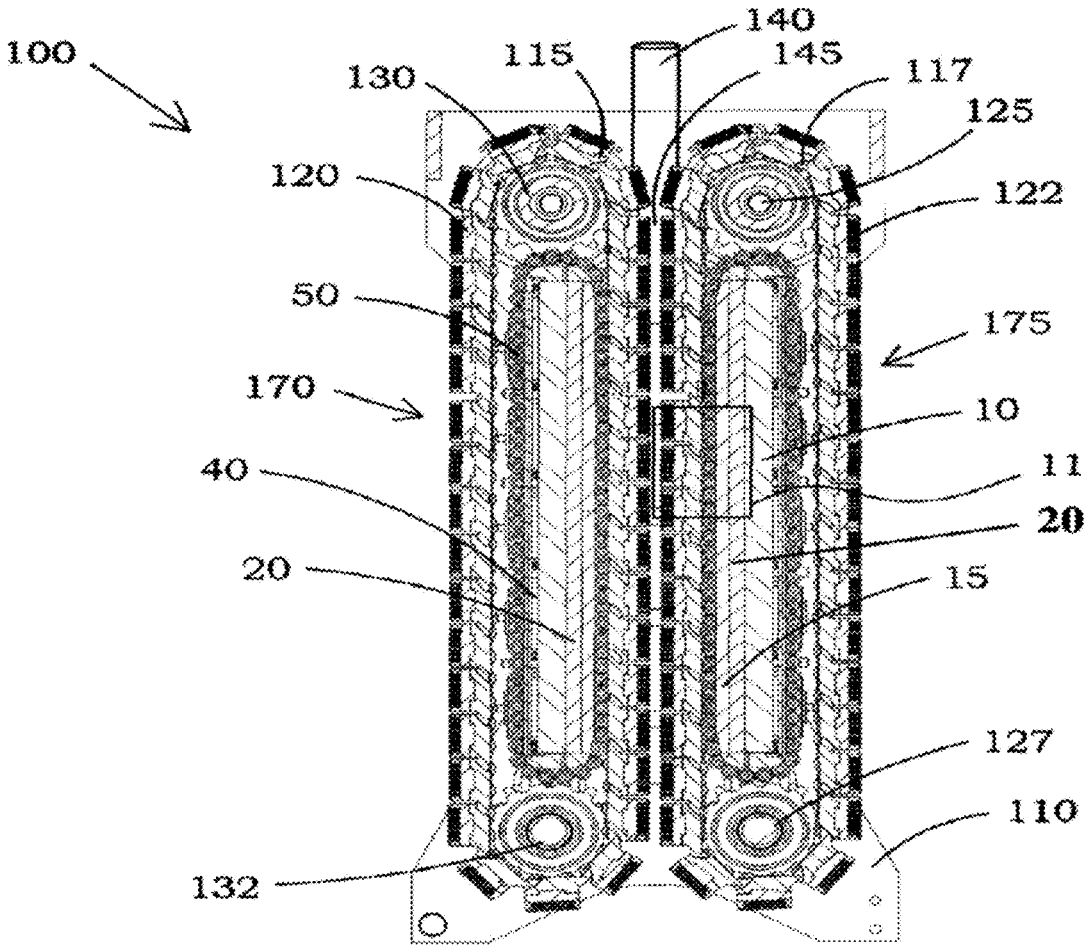
FIG. 3 is an elevational view, in section, of a coiled tubing injector apparatus in accord with one possible embodiment of the present invention.
Figure 4:
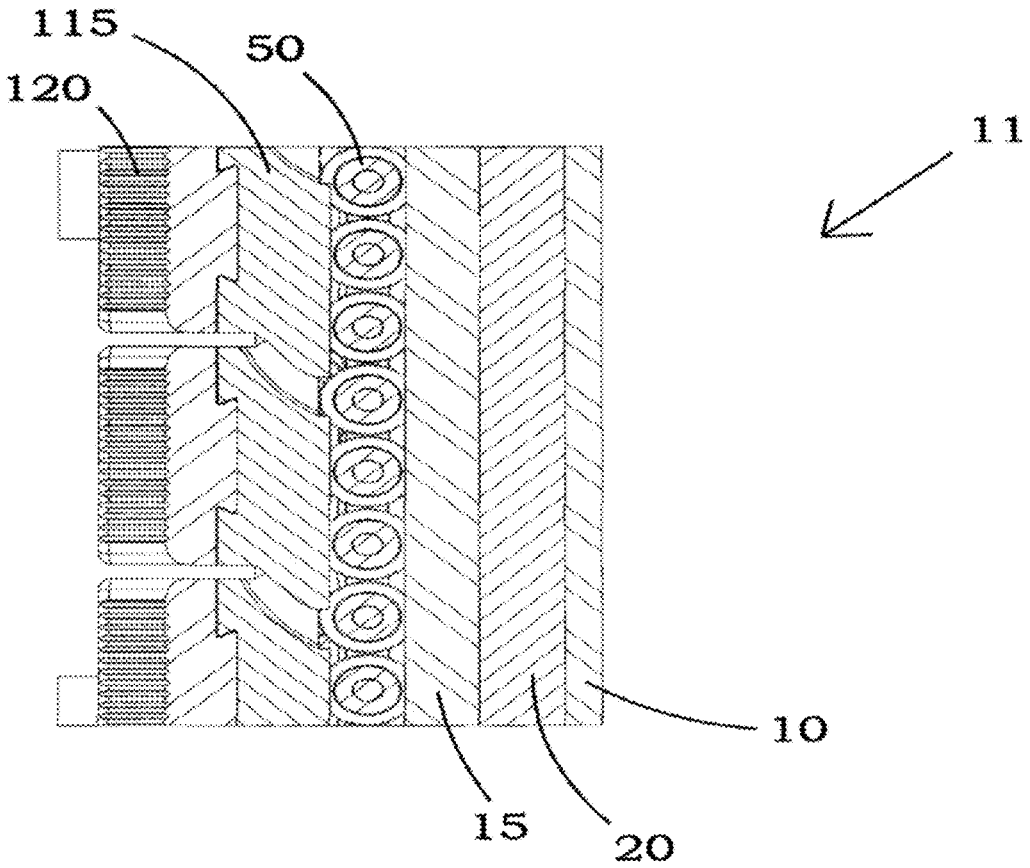
FIG. 4 is a side elevational view of a coiled tubing injector, partially in section, of section 10 of FIG. 3, in accord with one possible embodiment of the invention.

In FIG. 3, a front sectional view of coiled tubing injector 100 is depicted in accord with a preferred embodiment of the present invention. Coiled tubing injector 100 comprises first injector component 170 and second injector component 175 housed within frame 110. First injector component 170 and second injector component 175 may be identical or substantially identical in structure with regards to internal assembly 1 as described in conjunction with FIG. 1 and oppose each other with respect to central pathway 145. In operation, first injector component 170 and second injector component 175 are used in conjunction to insert and/or remove coiled tubing 140 from central pathway 145 using grippers 120, 122. Grippers 120, 122 interconnect with gripper bands 115, 117 respectively, with gripper band 115 revolving around gears or sprocket pair 130, 132, and gripper band 117 revolving around gears or sprocket pair 125, 127 respectively. In an alternative embodiment, gripper bands 155, 177 may be fashioned with grippers 120, 122 as a single, unified component.

Grippers 120, 122 apply pressure to coiled tubing 145 after being energized by hydraulic cylinders 40 being operated either manually or automatically, typically at a control room or at controls on frame 110. Hydraulic cylinders 40 are operable to expand and contract, thereby changing the pressure grippers 120, 122 apply onto coiled tubing 145, as well as converging first injector component 170 and second injector component 175 towards each other. Grippers 120, 122 may comprise a semicircular channel which provides a better contact area with coiled tubing 140, although various shapes of grippers 120, 122 may be employed consistent with the teachings of the present invention. In some embodiments, grippers 120, 122 may, if desired, comprise a substantially resilient material to depress for engaging with smaller diameter tubing or expand to handle larger diameter tubing.

Figure 5:
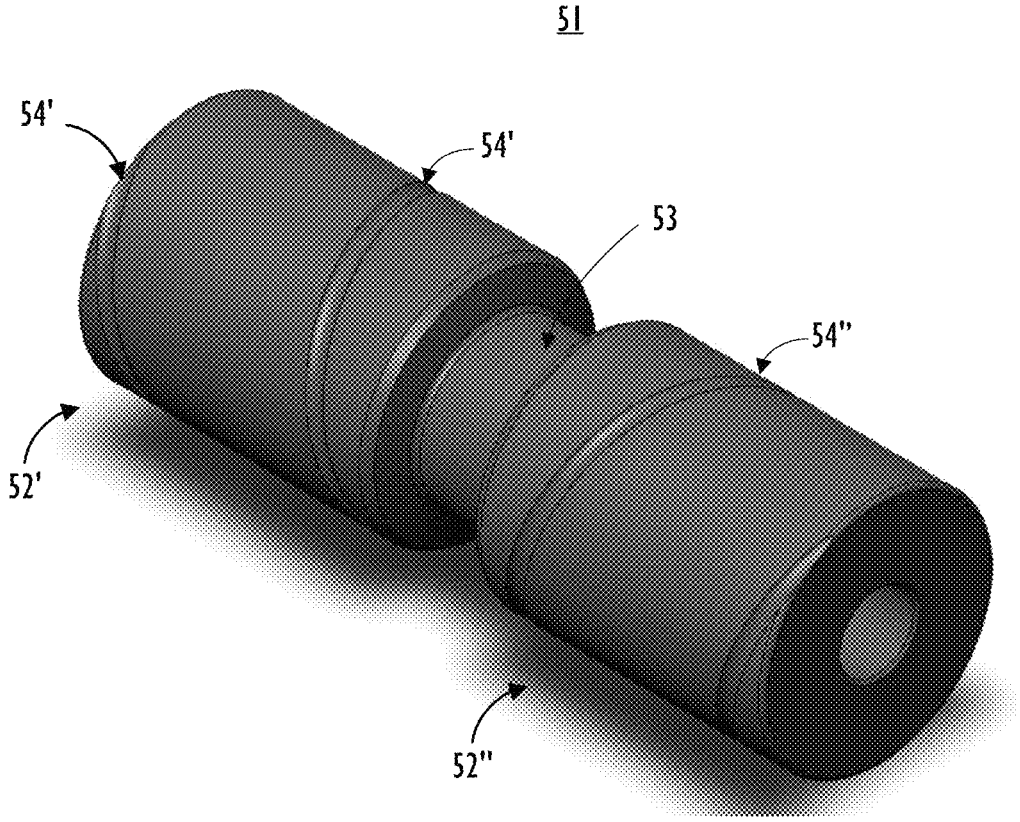
FIG. 5 is a grooved roller, in accord with one possible embodiment of the invention.

FIG. 5 is a grooved roller 51, in accord with one possible embodiment of the invention. The grooved rollers 51 ride on hardened wear plates and take the force of the interaction between the coil and the gripper block. Grooved roller 51 has two lobes 52 separated by an axle 53, with each lobe 51 having a groove tracing the circumference along a length thereof. In the embodiment of FIG. 2, the grooves 54 of each lobe 52 mirror one another across the axle 53 of each grooved roller 51. The grooves in the grooved rollers 51 facilitate transmission of lubricant (e.g., oil) by the rollers 51 as the rollers 51 rotate and move along wear plate 15 during normal operations.

Figure 6:
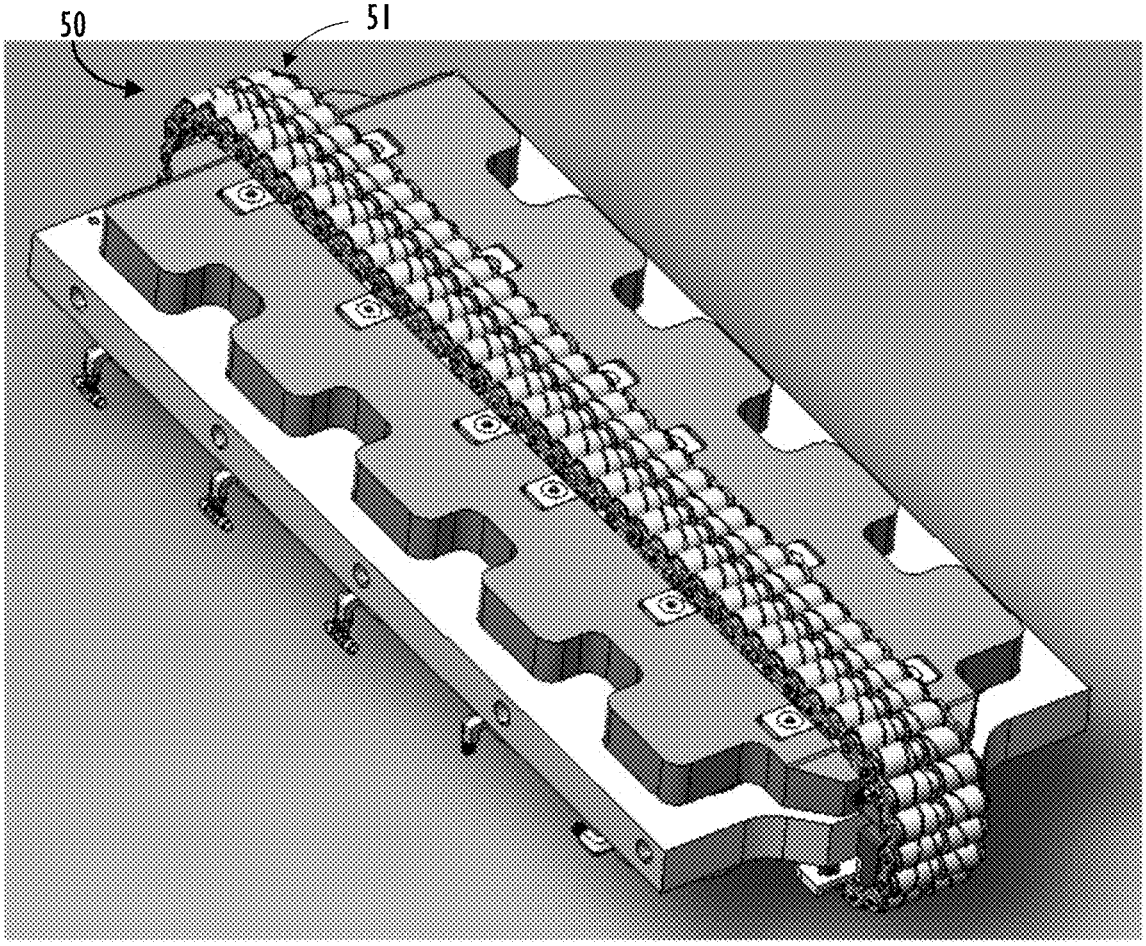
FIG. 6 is a bottom perspective view of a part of a coiled tubing injector apparatus showing a chain drive and skate plate in accord with one possible embodiment of the present invention.

FIG. 6 is a bottom perspective view of a part of a coiled tubing injector apparatus showing a chain drive and skate plate in accord with one possible embodiment of the present invention. In FIG. 6, Chain assembly 50 comprises a plurality of grooved rollers interconnected by a series of chain links rotating along track of wear plate 15 (See FIG. 1). As indicated above, each roller 51 has two lobes separated by an axle portion, with each lobe having a groove tracing the circumference along a length thereof. In the embodiment of FIG. 6, the grooves of each lobe mirror one another across the midway point of each roller 51. The grooves in the rollers 51 facilitate transmission of lubricant (e.g., oil) by the rollers 51 as the rollers move along wear plate 15 during normal operations.

Figure 7A:
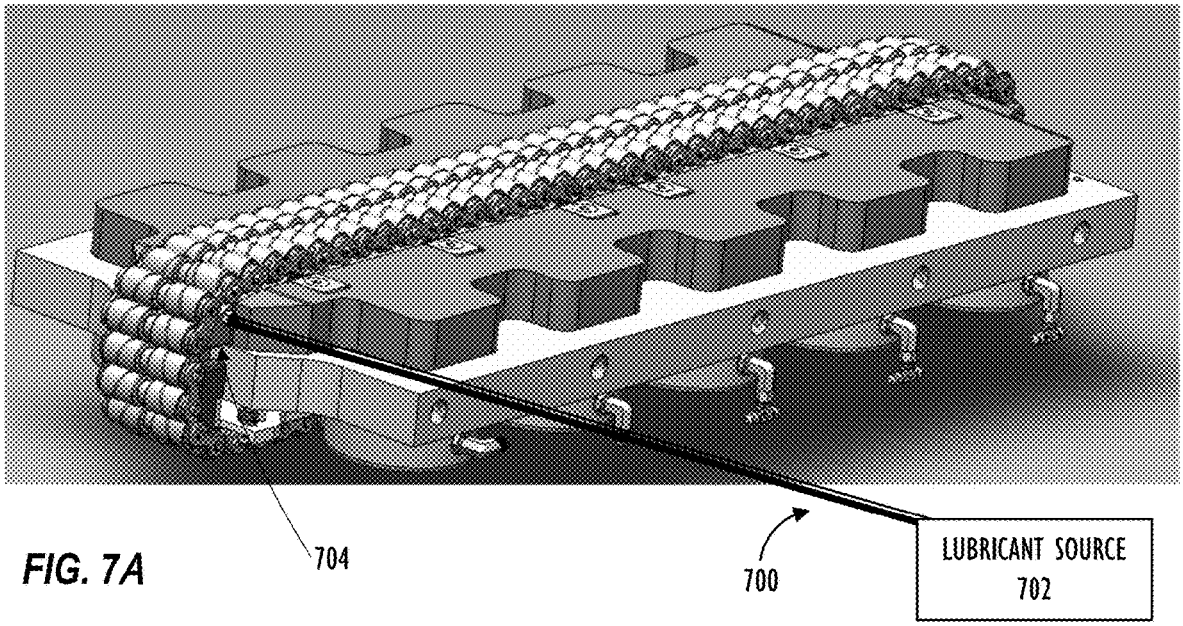
FIG. 7A is a side perspective view of a part of a coiled tubing injector apparatus showing a chain drive, skate plate and lubricant feed in accord with one possible embodiment of the present invention.

FIG. 7A is a side perspective view of a part of a coiled tubing injector apparatus showing a chain drive, skate plate and lubricant feed 700 in accord with one possible embodiment of the present invention. Lubricant source (e.g., a drive pump) 702 feeds lubricant to inlet 704 (with another inlet provided opposite).

Figure 7B:
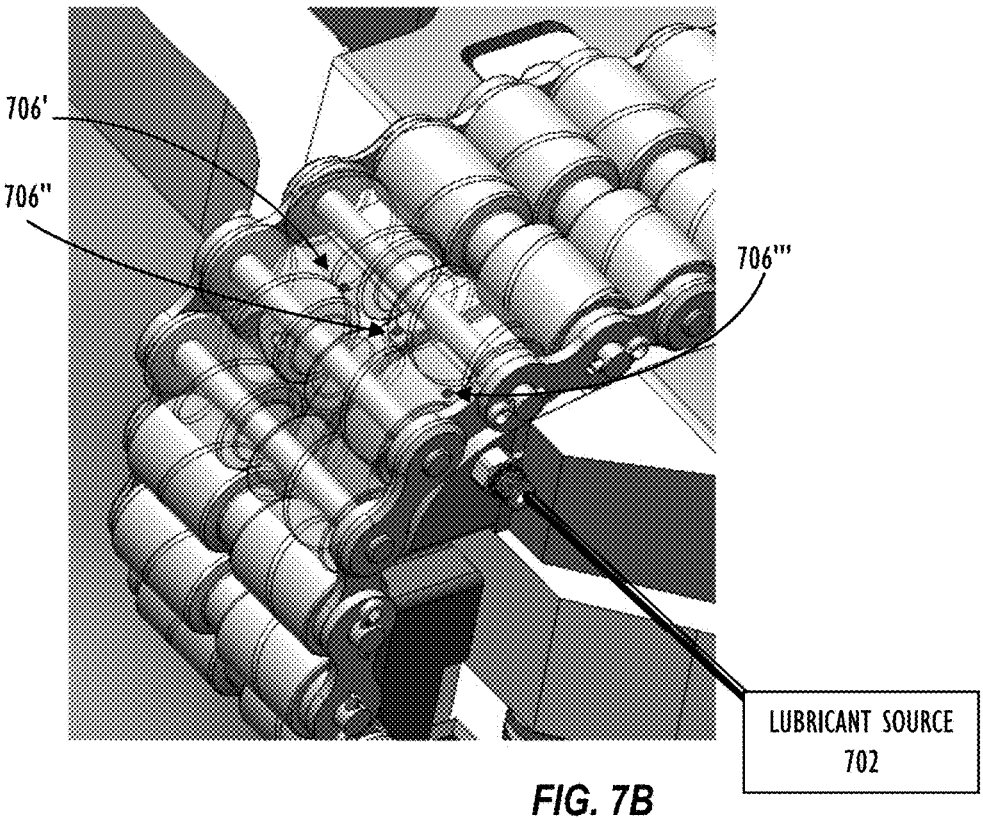
FIG. 7B is a cut-away perspective view of a part of a coiled tubing injector apparatus showing lubricant receive areas feed in accord with one possible embodiment of the present invention.

FIG. 7B is a cut-away perspective view of a part of a coiled tubing injector apparatus showing lubricant receive areas 706 feed in accord with one possible embodiment of the present invention. Lubricant source 702 urges lubricant through feed line 700, through receive areas 706. The grooves in the rollers urge the lubricant down the feedline, thereby reducing friction and heat as coil is fed by apparatus 100.

Referring now to FIG. 8, coiled tubing injector apparatus 100 is shown with adjustable base 165 for adjusting to various size wellheads. Adjustable base 165 is supported by posts 150, 155, 160 while the components of coiled tubing injector apparatus 100 as described hereinbefore are contained within frame 110. Grooved rollers 51 are partially visible.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only and are not exhaustive of the scope of the invention.

Consequently, the invention is intended to be limited only by the scope of the appended claims, giving full cognizance to equivalents in all respects.

What is claimed is:

1. A coiled tubing injector apparatus for inserting and removing coiled tubing from a wellhead, comprising:

a first and second band of opposed gripping members arranged for gripping said coiled tubing in a central pathway;

a first chain and a second chain operable to drive said first and second bands;

a first and second skate plate, each of said first and second skate plate defining a channel and a plurality of recesses along both sides of said channel;

a wear plate sized to fit within said channel of each said skate plate, said wear plate further comprising a plurality of openings, wherein said plurality of recesses and said plurality of openings align when said wear plate is inserted into said channel of each said skate plate;

a third chain comprising a plurality of rollers kept in place by a protuberance running along a length of the wear plate, each roller having at least one groove adapted to urge lubricant down at least a portion of the length of the wear plate; and a plurality of clamps for fastening each said wear plate to each said skate plate, wherein a first end of said plurality of clamps fits within said plurality of recesses and a second end of said plurality of clamps defines a tongue for insertion in said plurality of openings.

2. The apparatus of claim 1, further comprising at least one hydraulic cylinder operable for selectively compressing said first and second band of opposed gripping members.

3. The apparatus of claim 1, wherein said plurality of clamps are secured within said plurality of recesses with a plurality of fasteners.

4. The apparatus of claim 1, wherein said plurality of recesses each comprise a rectangular shaped aperture.

5. The apparatus of claim 1 further comprising first and second side plates positioned on each end of said wear plate.

6. The apparatus of claim 5, wherein each of said first and second side plates comprise a curved surface.

7. The apparatus of claim 1, wherein said wear plate is thicker than said channel so as to extend outwardly from each of said first and second skate plates.

8. The apparatus of claim 1, further comprising a first and second center plates positioned on an opposite side from said wear plate for said first and second skate plates.

9. The apparatus of claim 1, wherein said wear plate comprises a center track.

10. A coiled tubing injector apparatus, comprising:

a first injector column comprising a skate plate and a wear plate, said skate plate comprising a central track sized to receive said wear plate and a plurality of indentions along both sides of said central track, said wear plate further comprising a plurality of slots, wherein said plurality of slots and said plurality of indentions align when said wear plate is inserted into said central track of said skate plate, and a chain comprising a plurality of rollers kept in place by a protuberance running along a length of the wear plate, each roller having at least one groove adapted to urge lubricant down at least a portion of the length of the wear plate;

a second injector column comprising a skate plate and a wear plate, said skate plate comprising a central track sized to receive said wear plate and a plurality of indentions along both sides of said central track;

a plurality of clamps for fastening said wear plate to said skate plate of both said first injector column and said second injector column, each of said plurality of clamps forming an extension of said wear plate aligning with said plurality of indentions and operable for securing said wear plate in position relative to said skate plate;

a first band and a second band of opposed gripping members arranged for gripping coiled tubing in a central pathway; and a first gripper chain and a second gripper chain operable to drive said first and second bands of opposed gripping members.

11. The apparatus of claim 10, wherein said plurality of clamps each further comprise a tongue for insertion into said plurality of indentions of said skate plate.

12. The apparatus of claim 10, wherein said plurality of clamps are separate from said wear plate and fit within the plurality of slots within said wear plate.

13. The apparatus of claim 10, wherein said coiled tubing injector apparatus is housed within a frame.

14. The apparatus of claim 10 wherein said first and second injector columns further comprise first and second inner chains each further comprising a plurality of rolling elements.

15. The apparatus of claim 10 further comprising a plurality of hydraulic cylinders operable for exerting a compressing force on a plurality of gripping members to remove and/or insert a coiled tubing from a central pathway.

* * * * *